US009423749B2

(12) United States Patent
Kumagai et al.

(10) Patent No.: US 9,423,749 B2
(45) Date of Patent: Aug. 23, 2016

(54) IMAGE FORMING APPARATUS WITH A FULCRUM THAT PIVOTALLY SUPPORTS AN IMAGE BEARER AND DETECTOR

(71) Applicants: Naohiro Kumagai, Kanagawa (JP); Seiichi Kogure, Kanagawa (JP); Junpei Fujita, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(72) Inventors: Naohiro Kumagai, Kanagawa (JP); Seiichi Kogure, Kanagawa (JP); Junpei Fujita, Kanagawa (JP); Kazuki Yogosawa, Tokyo (JP); Kenji Sugiura, Kanagawa (JP); Yuuji Wada, Kanagawa (JP); Yusuke Mitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/800,083

(22) Filed: Jul. 15, 2015

(65) Prior Publication Data

US 2016/0033915 A1 Feb. 4, 2016

(30) Foreign Application Priority Data

Jul. 30, 2014 (JP) ..... 2014-154996
Oct. 31, 2014 (JP) ..... 2014-223325

(51) Int. Cl.
*G03G 15/00* (2006.01)

(52) U.S. Cl.
CPC ..... *G03G 15/5033* (2013.01); *G03G 15/5037* (2013.01); *G03G 2221/1654* (2013.01)

(58) Field of Classification Search
None
See application file for complete search history.

(56) References Cited

U.S. PATENT DOCUMENTS

| | | | | |
|---|---|---|---|---|
| 2008/0187343 | A1* | 8/2008 | Yamaguchi | G03G 15/0131 399/74 |
| 2010/0142985 | A1 | 6/2010 | Minbe et al. | |
| 2010/0221029 | A1 | 9/2010 | Minbu et al. | |
| 2011/0013920 | A1 | 1/2011 | Wada | |
| 2011/0158690 | A1 | 6/2011 | Mimbu et al. | |
| 2011/0206399 | A1 | 8/2011 | Fujita et al. | |
| 2011/0211855 | A1 | 9/2011 | Kogure et al. | |
| 2011/0293312 | A1 | 12/2011 | Mimbu et al. | |
| 2013/0223901 | A1 | 8/2013 | Minbe et al. | |
| 2014/0072340 | A1 | 3/2014 | Kato et al. | |
| 2014/0241744 | A1 | 8/2014 | Ichikawa et al. | |
| 2014/0334847 | A1 | 11/2014 | Takahashi et al. | |
| 2015/0037054 | A1 | 2/2015 | Nagata et al. | |

FOREIGN PATENT DOCUMENTS

| | | | |
|---|---|---|---|
| JP | 62050843 A | * | 3/1987 |
| JP | 11-237773 | | 8/1999 |
| JP | 2009-075479 | | 4/2009 |
| JP | 5473590 B2 | * | 4/2014 |

OTHER PUBLICATIONS

U.S. Appl. No. 14/601,445, filed Jan. 21, 2015.

* cited by examiner

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

An image forming apparatus includes an image bearer, a detector, an image bearer support, and a fulcrum. The image bearer bears an image on a surface thereof. The detector detects a condition of the image bearer. The image bearer support supports the image bearer and includes a stopper to regulate movement of the detector. The fulcrum pivotally supports the image bearer and the detector.

17 Claims, 13 Drawing Sheets

IMAGE FORMING APPARATUS WITH A FULCRUM THAT PIVOTALLY SUPPORTS AN IMAGE BEARER AND DETECTOR

CROSS-REFERENCE TO RELATED APPLICATIONS

This patent application is based on and claims priority pursuant to 35 U.S.C. §119 from Japanese Patent Application Nos. 2014-154996, filed on Jul. 30, 2014, and 2014-223325, filed on Oct. 31, 2014, both in the Japan Patent Office, which are hereby incorporated herein by reference in their entirety.

BACKGROUND

1. Technical Field

Exemplary aspects of the present disclosure generally relate to an image forming apparatus including a detector to detect conditions of an image bearer.

2. Description of the Related Art

Generally, known image forming apparatuses include an optical detector to detect conditions of an image bearer. The optical detector is disposed opposite to the image bearer with a certain space therebetween. The detection accuracy of the detector depends largely on the positional accuracy (distance) of the image bearer as a detection target and the detector.

SUMMARY

In view of the foregoing, in an aspect of this disclosure, there is provided an improved image forming apparatus including an image bearer, a detector, an image bearer support, and a fulcrum. The image bearer bears an image on a surface thereof. The detector detects a condition of the image bearer. The image bearer support supports the image bearer and includes a stopper to regulate movement of the detector. The fulcrum pivotally supports the image bearer and the detector.

According to another aspect, an image forming apparatus includes an image bearer, a detector, a first support, and a detector retainer. The image bearer bears an image on a surface thereof. The detector detects a condition of the image bearer. The first support pivotally supports the image bearer about a fulcrum. The detector retainer pivotally supports the detector about the fulcrum. The first support includes a stopper to regulate movement of the detector retainer.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
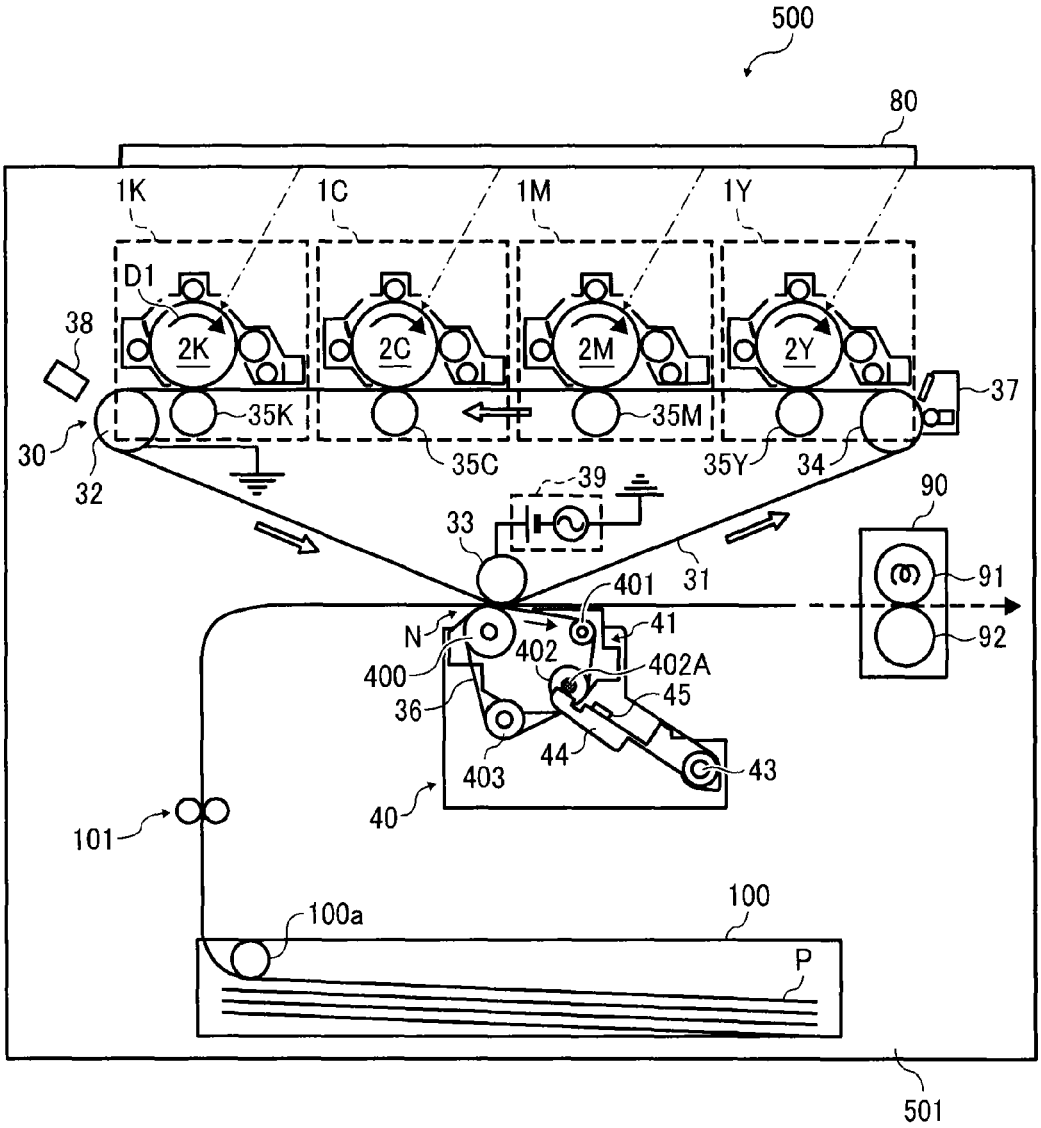
FIG. 1 is a schematic diagram illustrating a printer as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

In order to prevent fluctuations in the distance between the detector that detects a toner pattern formed on a belt as the image bearer and the belt, in one example, there is known an image forming apparatus that employs a support to support and to position the detector in place relative to the belt and a roller around which the belt is looped.

Since the rotary body, the support, and the detector are constituted as a single integrated unit and detachably attachable all together relative to the main body of the image forming apparatus, the detector is forced to be detached from the main body upon replacement of the unit and/or the detector is detached from the unit, and then the detector is assembled to a new unit, thereby complicating assembling operation.

In another example of the image forming apparatus, the detector is disposed on the main body side of the image forming apparatus and is not detachably attachable. The detector is swingably supported by a support that contacts a shaft of a rotary body around which the belt as the image bearer is looped. Accordingly, the distance between the detector and the belt is maintained.

In this configuration, the support that supports the detector is swingably disposed in the main body of the image forming apparatus and positioned in place by contacting the shaft of the roller so that the detector does not need to be replaced or reassembled. However, vibrations from the unit and the main body during printing cause displacement of the detector.

In view of the above, there is thus an unsolved need for an image forming apparatus capable of maintaining reliably a desired distance between the detector and the image bearer.

With reference to FIG. 1, a description is provided of an electrophotographic color printer as an example of an image forming apparatus 500 according to an illustrative embodiment of the present disclosure. The image forming apparatus of the present disclosure is not limited to a printer. The image forming apparatus includes, but is not limited to, a copier, a printer, a facsimile machine, and a multi-functional system including a combination thereof. A printer refers also to a plotter.

As illustrated in FIG. 1, the image forming apparatus 500 includes four image forming units 1Y, 1M, 1C, and 1K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 500 includes a transfer unit 30 serving as a transfer device, an optical writing unit 80, a fixing device 90, a paper cassette 100, and a pair of registration rollers 101.

The image forming units 1Y, 1M, 1C, and 1K all have the same configuration as all the others, differing only in the color of toner employed as a powder-form developing agent. The image forming units 1Y, 1M, 1C, and 1K are replaced upon reaching their product life cycles. According to the illustrative embodiment, the image forming units 1Y, 1M, 1C, and 1K are detachably attachable relative to a main body 501 of the image forming apparatus 500 and replaceable.

Figure 2:
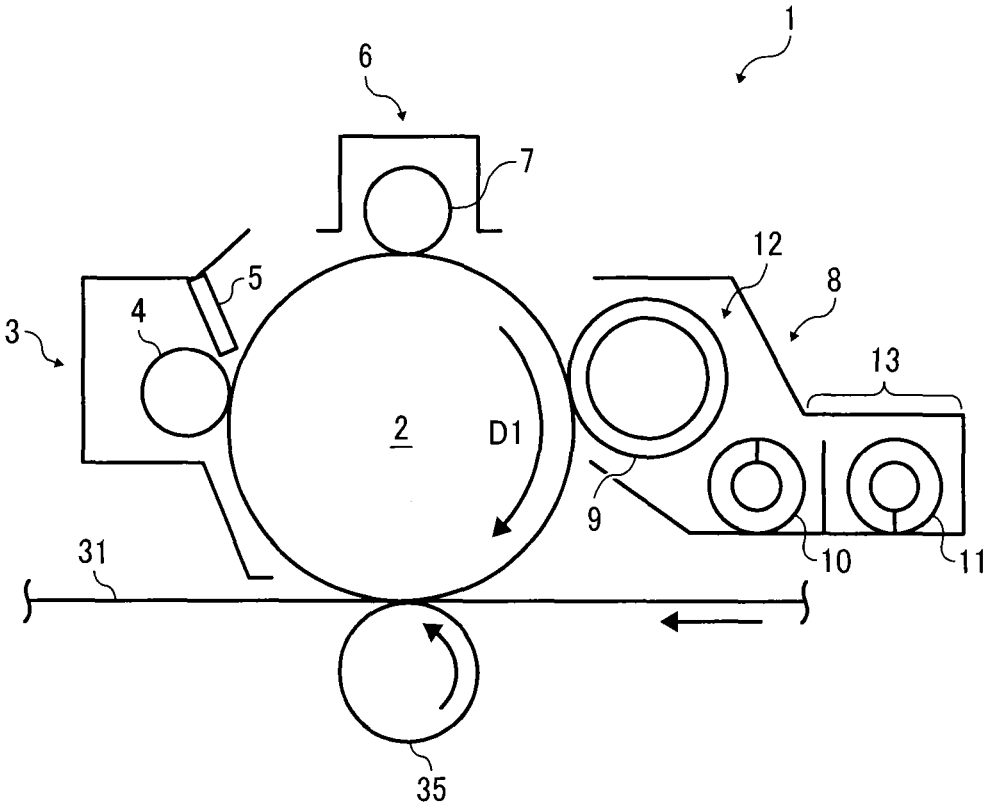
FIG. 2 is an enlarged schematic diagram illustrating an example of an image forming unit employed in the image forming apparatus of FIG. 1.

FIG. 2 is an enlarged diagram schematically illustrating one of the image forming units 1Y, 1M, 1C, and 1K as a representative example. The image forming units 1Y, 1M, 1C, and 1K all have the same configuration as all the others, differing only in the color of toner employed. Thus, the description is provided without the suffixes Y, M, C, and K indicating colors unless differentiation of the color is necessary.

The image forming unit 1 includes a drum-shaped photoconductor 2 serving as a latent image bearer, a photoconductor cleaner 3, a static eliminator, a charging device 6, a developing device 8, and so forth. These devices are held in a common casing so that they are detachably installable and replaceable all together relative to the main body 501, thereby constituting a process cartridge.

The photoconductor 2 comprises a drum-shaped base on which an organic photosensitive layer is disposed. The photoconductor 2 is rotated in a clockwise direction indicated by arrow D1 by a driving device. The charging device 6 includes a charging roller 7 to which a charging bias is applied. The charging roller 7 contacts or approaches the photoconductor 2 to generate an electrical discharge therebetween, thereby charging uniformly the surface of the photoconductor 2. Instead of using the charging roller 7 or the like that contacts or disposed close to the photoconductor 2, a corona charger or the like that does not contact the photoconductor 2 may be employed.

The uniformly charged surface of the photoconductor 2 by the charging roller 7 is scanned by exposure light such as a light beam projected from the optical writing unit 80, thereby forming an electrostatic latent image for black on the surface of the photoconductor 2. The electrostatic latent image on the photoconductor 2 is developed with toner of the respective color by the developing device 8. Accordingly, a visible image, also known as a toner image, is formed. The toner image formed on the photoconductor 2 is transferred primarily onto an intermediate transfer belt 31 formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The photoconductor cleaner 3 includes a brush roller 4 which is rotated and a cleaning blade 5. The cleaning blade 5 is cantilevered, that is, one end thereof is fixed to a housing of the photoconductor cleaner 3, and the other end is a free end that contacts the surface of the photoconductor 2. The brush roller 4 rotates and brushes off the residual toner from the surface of the photoconductor 2 while the cleaning blade 5 scraping off the residual toner from the surface.

The static eliminator may employ a known static eliminating device and removes residual charge remaining on the photoconductor 2 after the surface thereof is cleaned by the photoconductor cleaner 3 in preparation for the subsequent imaging cycle. The surface of the photoconductor 2 is initialized in preparation for the subsequent imaging cycle.

The developing device 8 includes a developing portion 12 and a developer conveyer 13. The developing portion 12 includes a developing roller 9 inside thereof. The developer conveyer 13 mixes and transports the developing agent. The developer conveyer 13 includes a first chamber equipped with a first screw 10 and a second chamber equipped with a second screw 11. The first screw 10 and the second screw 11 are rotatably supported by a casing or the like of the developing device 8. The first screw 10 and the second screw 11 are rotated to deliver the developing agent to the developing roller 9 while circulating the developing agent.

As illustrated in FIG. 1, the optical writing unit 80 for writing a latent image on the photoconductors 2 is disposed above the image forming units 1Y, 1M, 1C, and 1K. Based on image information received from an external device such as a personal computer (PC), the optical writing unit 80 scans optically the photoconductors 2Y, 2M, 2C, and 2K with a light beam projected from a laser diode of the optical writing unit 80. Accordingly, the electrostatic latent images of yellow, magenta, cyan, and black are formed on the photoconductors 2Y, 2M, 2C, and 2K, respectively.

Referring back to FIG. 1, a description is provided of the transfer unit 30. The transfer unit 30 is disposed substantially below the image forming units 1Y, 1M, 1C, and 1K. The transfer unit 30 includes the intermediate transfer belt 31 serving as an image bearer formed into an endless loop and rotated in the counterclockwise direction. The transfer unit 30 also includes a plurality of rollers: a drive roller 32, a secondary-transfer back surface roller 33, a cleaning auxiliary roller 34, and four primary transfer rollers 35Y, 35M, 35C, and 35K (which may be referred to collectively as primary transfer rollers 35). The primary transfer rollers 35Y, 35M, 35C, and 35K are disposed opposite the photoconductors 2Y, 2M, 2C, and 2K, respectively, via the intermediate transfer belt 31. The transfer unit 30 is detachably attachable (replaceable) relative to the main body 501.

Outside the loop formed by the intermediate transfer belt 31, a secondary transfer unit 41, a belt cleaner 37, a voltage detector 38 are disposed. The secondary transfer unit 41 includes a secondary transfer belt 36 serving as an image bearer and also as a secondary transfer device. The secondary-transfer back surface roller 33 can be also referred to as a secondary-transfer opposed roller.

The intermediate transfer belt 31 is looped around and stretched taut between the plurality of rollers, i.e., the drive roller 32, the secondary-transfer back surface roller 33, the cleaning auxiliary roller 34, and the four primary transfer rollers 35Y, 35M, 35C, and 35K. The drive roller 32 is rotated in the counterclockwise direction by a motor or the like, and rotation of the drive roller 32 enables the intermediate transfer belt 31 to rotate in the same direction. In the transfer unit 30, the intermediate transfer belt 31 is looped around the plurality of rollers, thereby delivering the recording medium P.

The intermediate transfer belt 31 is interposed between the primary transfer rollers 35Y, 35M, 35C, and 35K, and photoconductors 2Y, 2M, 2C, and 2K, thereby forming primary transfer nips serving as transfer sections for each color between the front surface or the image bearing surface of the intermediate transfer belt 31 and the photoconductors 2Y, 2M, 2C, and 2K. A primary transfer bias is applied to the primary transfer rollers 35Y, 35M, 35C, and 35K by a transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

A yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. The intermediate transfer belt 31, on which the yellow toner image has been transferred, passes through the primary transfer nips of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process. Accordingly, a composite toner image, in which the toner images of four different colors are superimposed on one atop the other, is formed on the surface of the intermediate transfer belt 31 in the primary transfer process.

According to the present illustrative embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device.

The secondary transfer unit 41 is disposed outside the loop of the intermediate transfer belt 31. A nip forming roller 400 of the transfer unit 30 is disposed outside the loop formed by the intermediate transfer belt 31, opposite to the secondary-transfer back surface roller 33. The intermediate transfer belt 31 is interposed between the secondary-transfer back surface roller 33 and the nip forming roller 400, thereby forming a secondary transfer nip N at which the front surface of the intermediate transfer belt 31 contacts the secondary transfer belt 36. The secondary transfer belt 36 is grounded.

By contrast, a secondary transfer bias is applied to the secondary-transfer back surface roller 33 by a secondary-transfer bias power source 39. With this configuration, a secondary-transfer electrical field is formed between the secondary-transfer back surface roller 33 and the secondary transfer belt 36 so that the toner having a negative polarity is moved electrostatically from the secondary-transfer back surface roller 33 to the secondary transfer belt 36.

As illustrated in FIG. 1, the paper cassette 100 storing a sheaf of recording media P such as paper sheets and resin sheets is disposed below the transfer unit 30. The paper cassette 100 is equipped with a feed roller 100*a* to contact the top sheet of recording media P in the paper cassette 100. As the feed roller 100*a* is rotated at a predetermined speed, the feed roller 100*a* picks up and sends the top sheet of the recording media P to a delivery path. Substantially near the end of the delivery path, a pair of registration rollers 101 is disposed. The pair of registration rollers 101 temporarily stops rotating, immediately after the recording medium P delivered from the paper cassette 100 is interposed therebetween. The pair of registration rollers 101 starts to rotate again to feed the recording medium P to the secondary transfer nip N in appropriate timing such that the recording medium P is aligned with the composite toner image formed on the intermediate transfer belt 31 in the secondary transfer nip N.

In the transfer unit 30, the intermediate transfer belt 31 is an endless looped belt serving as an image bearer onto which a toner image is transferred, and is looped around the plurality of rollers, i.e., the drive roller 32, the secondary-transfer back surface roller 33, and the cleaning auxiliary roller 34. The toner image transferred on the intermediate transfer belt 31 is delivered to the secondary transfer nip N at which the toner image is transferred from the intermediate transfer belt 31 to the recording medium P in the secondary transfer process.

In the secondary transfer nip, the recording medium P tightly contacts the composite toner image on the intermediate transfer belt 31, and the composite toner image is transferred onto the recording medium P by the secondary transfer electric field and the nip pressure applied thereto, thereby forming a color image on the surface of the recording medium P.

After the intermediate transfer belt 31 passes through the secondary transfer nip N, the toner residue not having been transferred onto the recording medium P remains on the intermediate transfer belt 31. The toner residue is removed from the intermediate transfer belt 31 by the belt cleaner 37 which contacts the surface of the intermediate transfer belt 31. The cleaning auxiliary roller 34 disposed inside the loop formed by the intermediate transfer belt 31 supports the cleaning operation performed by the belt cleaner 37.

The voltage detector 38 is disposed outside the loop formed by the intermediate transfer belt 31. More specifically, the voltage detector 38 is disposed opposite to a portion of the intermediate transfer belt 31 wound around the drive roller 32 with a predetermined gap between the voltage detector 38 and the intermediate transfer belt 31. The surface potential of the toner image primarily transferred onto the intermediate transfer belt 31 is measured when the toner image comes to the position opposite to the voltage detector 38.

The fixing device 90 is disposed on the right side in FIG. 1, that is, downstream from the secondary transfer nip N in the direction of conveyance of the recording medium P. The fixing device 90 may be a known fixing device. After the secondary transfer, the recording medium, onto which the composite color toner image is transferred, is transported to the fixing device 90. The fixing device 90 includes a fixing roller 91 including a heat source inside thereof and a pressing roller 92. The fixing roller 91 and the pressing roller 92 contact to form the fixing nip where heat and pressure are applied. The composite toner image is softened and fixed on the recording medium P as the recording medium P passes through the fixing nip. After the toner image is fixed to the recording medium P, the recording medium P is output from the fixing device 90. Subsequently, the recording medium P is delivered outside the image forming apparatus 500 via a post-fixing medium path.

In the image forming apparatus 500 of the present disclosure, in a case in which a monochrome image is formed, a movable support plate supporting the primary transfer rollers 35Y, 35M, and 35C of the transfer unit 30 is moved to separate the primary transfer rollers 35Y, 35M, and 35C from the photoconductors 2Y, 2M, and 2C. Accordingly, the front surface or the outer peripheral surface of the intermediate transfer belt 31 is separated from the photoconductors 2Y, 2M, and 2C so that the intermediate transfer belt 31 contacts only the photoconductor 2K. In this state, only the image forming unit 1K among four image forming units is driven to form a black toner image on the photoconductor 2K.

Figure 3:
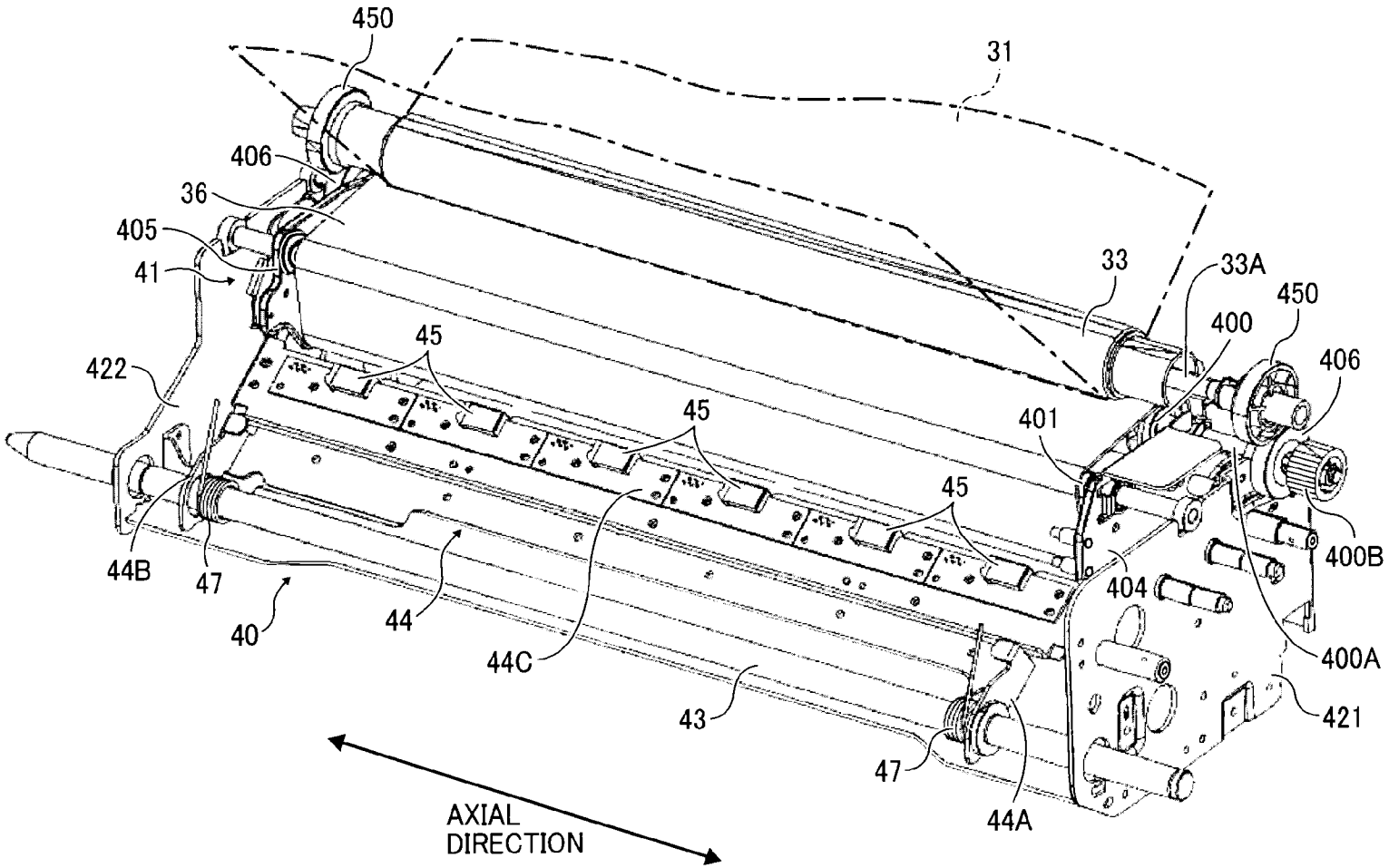
FIG. 3 is a perspective view schematically illustrating an image bearer support that supports an image bearer when the image bearer support is installed on a main-body side support having a common fulcrum.
Figure 4:
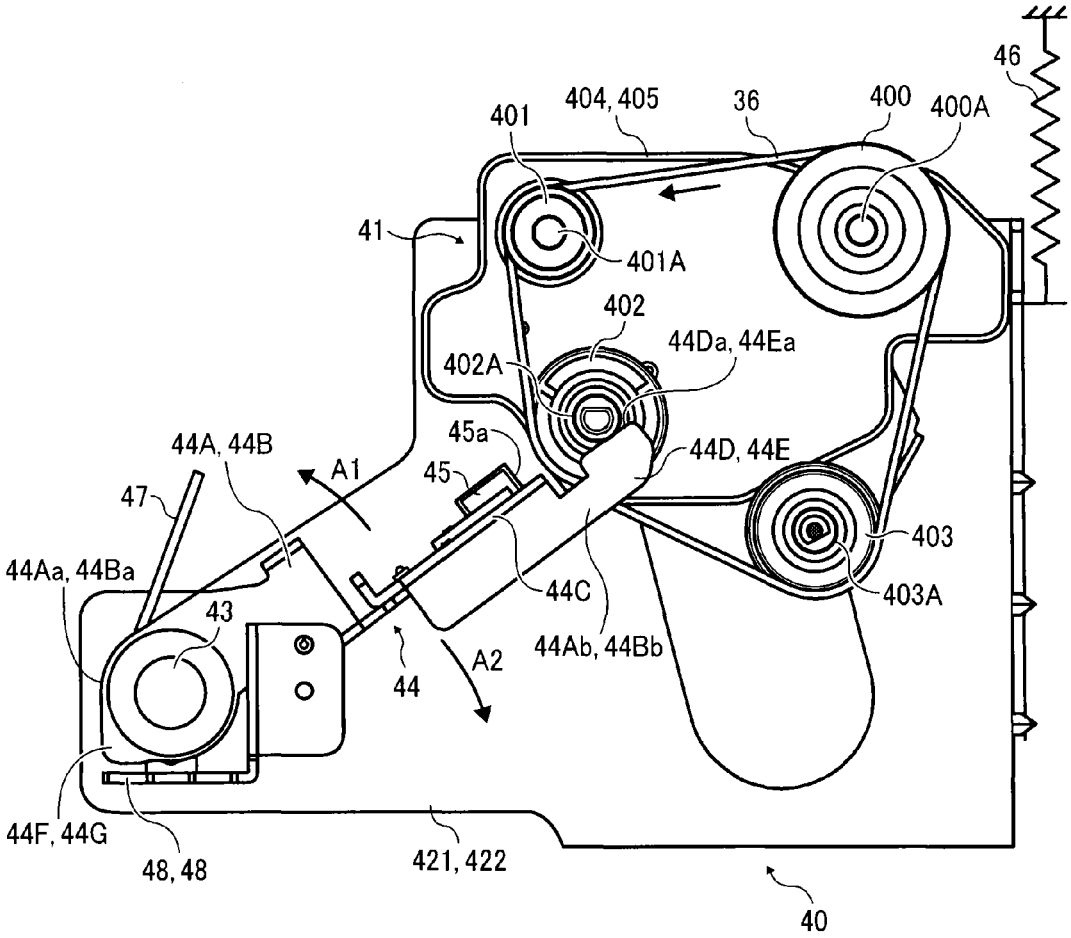
FIG. 4 is a side view schematically illustrating the image bearer support of Embodiment 1 installed on the main-body side support.
Figure 5:
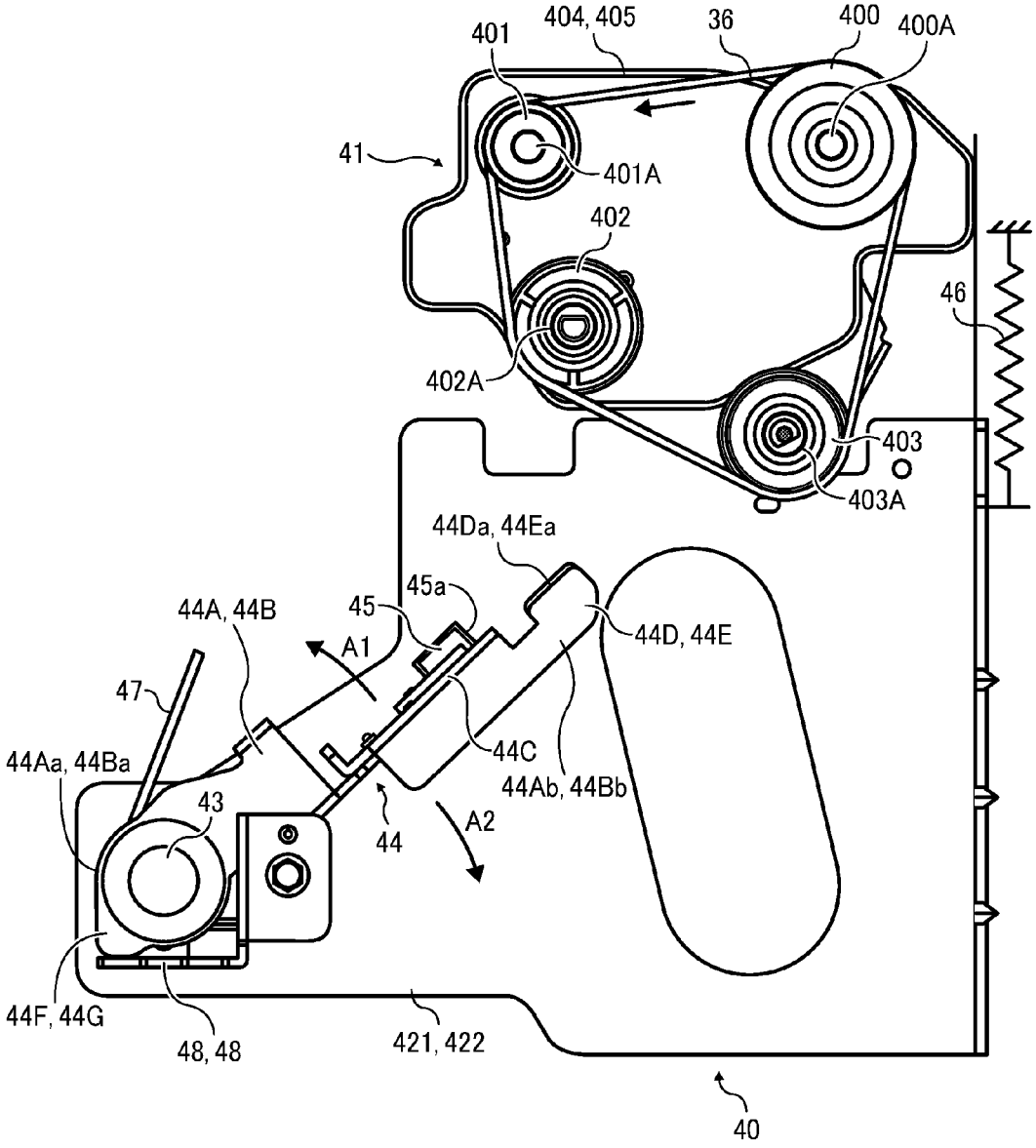
FIG. 5 is a side view schematically illustrating the image bearer support of Embodiment 1 separated from the main-body side support.

With reference to FIGS. 3, 4, and 5, a description is provided of a first support assembly 40 as a main-body side support that supports the secondary transfer unit 41 which serves as an image bearer support.

As illustrated in FIGS. 3, 4, and 5, the main body 501 of the image forming apparatus 500 includes the secondary transfer unit 41 and the first support assembly 40 that supports the secondary transfer unit 41. The first support assembly 40 detachably supports the secondary transfer unit 41. The secondary transfer unit 41 is replaceable relative to the first support assembly 40. FIG. 4 illustrates a state in which the secondary transfer unit 41 is installed in the first support assembly 40. FIG. 5 illustrates a state in which the secondary transfer unit 41 is detached from the first support assembly 40. It is to be noted that FIGS. 4 through 7, and 9 and 10 are side views of the first support assembly 40 and the secondary transfer unit 41, illustrated in an opposite orientation to the orientation shown in FIG. 1.

The secondary transfer unit 41 includes the secondary-transfer back surface roller 33, the nip forming roller 400 disposed opposite to the secondary-transfer back surface roller 33 via the intermediate transfer belt 31, three rollers 401, 402, and 403, and the secondary transfer belt 36 serving as an image bearer looped around the nip forming roller 400 and three rollers 401, 402, and 403. The secondary transfer unit 41 is a belt conveyor in which the secondary transfer belt 36 is an endless looped belt serving as an image bearer, and is looped around the plurality of rollers, i.e., the nip forming roller 400, and the rollers 401, 402, and 403. The nip forming roller 400 can also be referred to as a secondary transfer roller. The roller 401 can also be referred to as a separation roller.

The nip forming roller 400 secondarily transfers the toner image on the intermediate transfer belt 31 onto the recording medium P. The nip forming roller 400 is disposed inside the belt loop of the secondary transfer belt 36, facing to the secondary-transfer back surface roller 33. The intermediate transfer belt 31 and the secondary transfer belt 36 are interposed between the nip forming roller 400 and the secondary-transfer back surface roller 33. The nip forming roller 400 is biased against the intermediate transfer belt 31 so as to pressingly contact the intermediate transfer belt 31, thereby forming the secondary transfer nip N between the intermediate transfer belt 31 and the secondary transfer belt 36.

A bias for the secondary transfer or a secondary transfer bias is applied to the nip forming roller 400 or to the secondary-transfer back surface roller 33. In a case in which the secondary transfer bias is applied to the nip forming roller 400, the secondary transfer bias having a polarity opposite that of the toner is applied thereto. In a case in which the secondary transfer bias is applied to the secondary-transfer back surface roller 33, the secondary transfer bias having the same polarity as that of the toner is applied thereto.

The roller 401 is to strip the recording medium P electrostatically absorbed to the secondary transfer belt 36 from the secondary transfer belt 36 by self stripping.

As illustrated in FIG. 4, the nip forming roller 400, and the rollers 401, 402, and 403 are rotatably supported by roller shafts 400A, 401A, 402A, and 403A, respectively, on a pair of lateral plates 404 and 405 disposed in a longitudinal direction of the rollers. The secondary transfer belt 36 contacting the intermediate transfer belt 31 causes the nip forming roller 400, and the rollers 401, 402, and 403 to rotate. Alternatively, a driving gear 400B disposed on the roller shaft 400A rotates the nip forming roller 400, and the rollers 401, 402, and 403. According to the present illustrative embodiment, the place where the peripheral surface of the intermediate transfer belt 31 and the secondary transfer belt 36 contact is a so-called secondary transfer nip N. The secondary transfer unit 41 is contactable and separable relative to the intermediate transfer belt 31 while the secondary transfer unit 41 is installed in the first support assembly 40.

The first support assembly 40 includes base plates 421 and 422, a rotary shaft 43 disposed on the base plates 421 and 422, a detector retainer 44 disposed on the rotary shaft 43, a pattern detector 45 supported by the detector retainer 44, and a coil spring 46 serving as a biasing device to bias the first support assembly 40 as a whole against the secondary-transfer back surface roller 33. The base plates 421 and 422 are spaced apart a certain distance in the longitudinal direction of the nip forming roller 400. The coil spring 46 is a tension spring.

When installed in the first support assembly 40, the secondary transfer unit 41 and the first support assembly 40 become a single integrated unit. Therefore, as the first support assembly 40 is biased against the secondary-transfer back surface roller 33 by the coil spring 46, the secondary transfer unit 41 is biased against the secondary-transfer back surface roller 33 (intermediate transfer belt 31).

Figure 6:
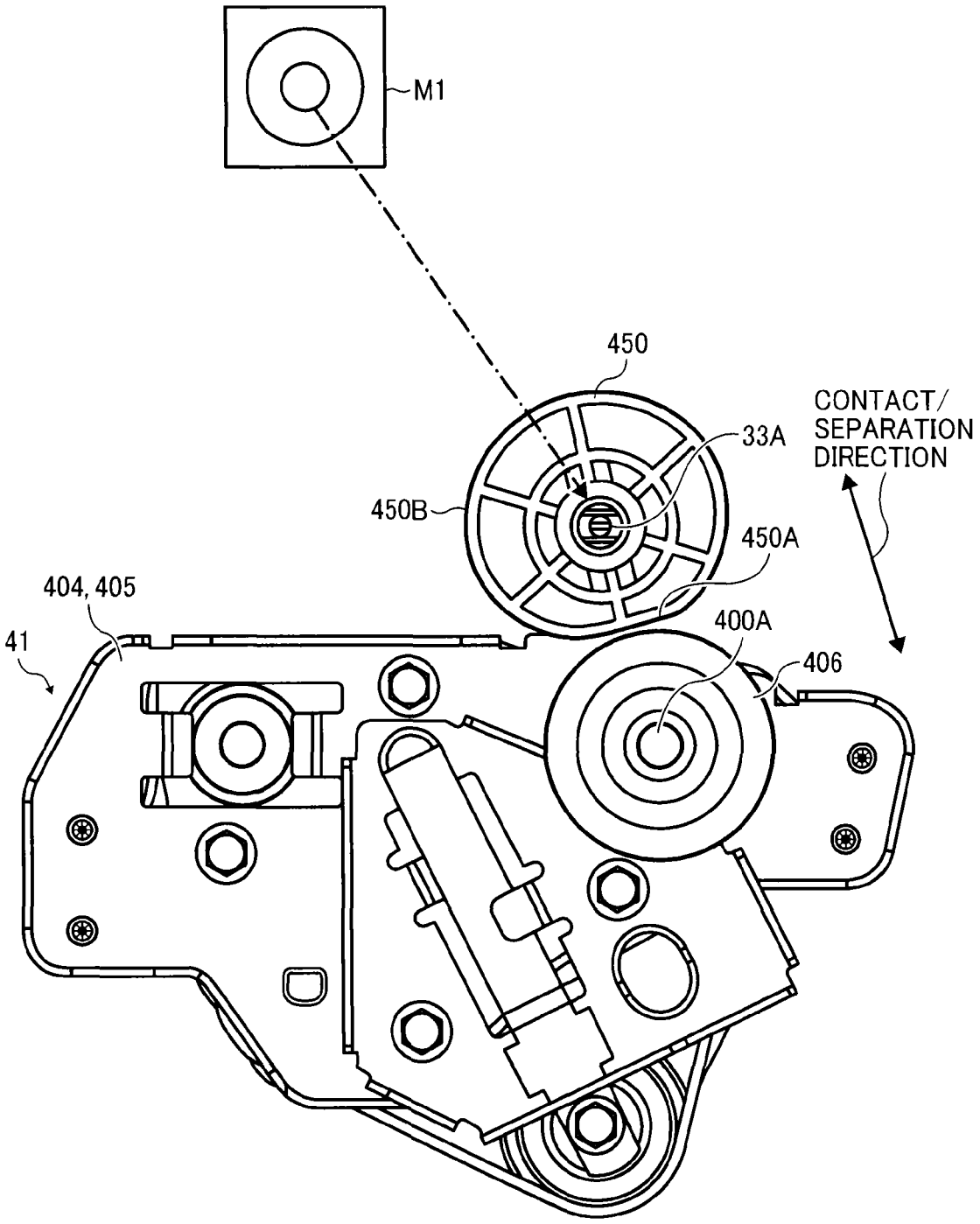
FIG. 6 is a side view schematically illustrating a contact-and-separation mechanism of the image bearer support in a separated state.
Figure 7:
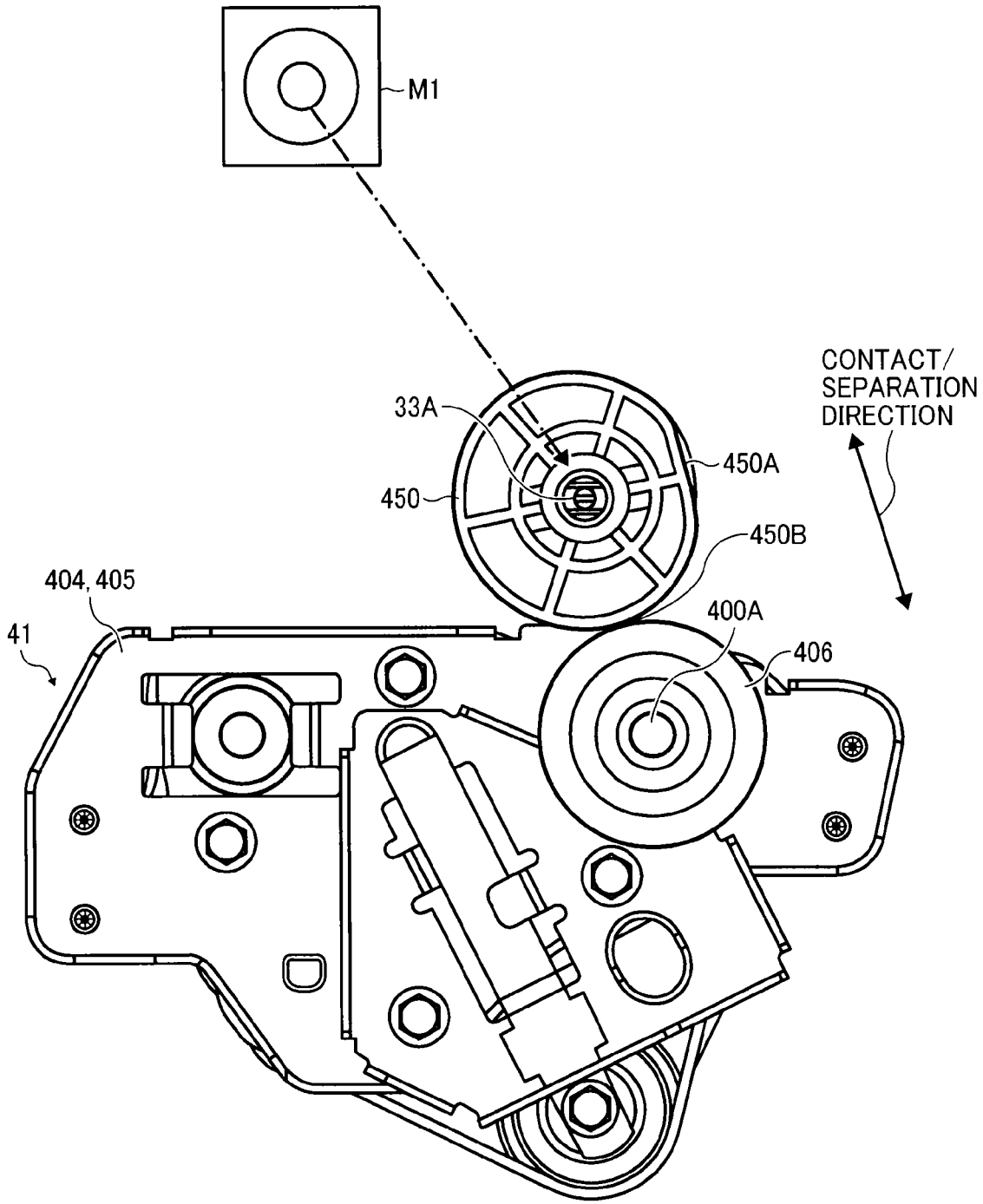
FIG. 7 is a side view schematically illustrating the contact-and-separation mechanism of the image bearer support in a contact state.

As illustrated in FIGS. 6 and 7, a pair of eccentric cams 450 is disposed on a shaft 33A of the secondary-transfer back surface roller 33. The pair of eccentric cams 450 moves the secondary transfer belt 36 to contact and separate from the intermediate transfer belt 31. A pair of rollers 406 as a receiver is disposed on the shaft 400A of the nip forming roller 400 (secondary transfer roller), opposite to the pair of eccentric cams 450. Each of the rollers 406 is rotatably disposed on each end of the shaft 400A supporting the nip forming roller 400 in the axial direction thereof.

Each of the eccentric cams 450 is disposed on each end of the shaft 33A in the axial direction thereof supporting the secondary-transfer back surface roller 33 such that the pair of eccentric cams 450 rotates integrally with the shaft 33A. The pair of eccentric cams 450 contacts the pair of rollers 406. As illustrated in FIG. 6, the shaft 33A on which the pair of eccentric cams 450 is disposed is rotated by a drive motor M1 serving as a contact-and-separation drive source. In this configuration, as the shaft 33A is rotated by the drive motor M1, the angle of each eccentric cam 450 changes.

Each eccentric cam 450 includes a first cam portion 450A and a second cam portion 450B on an outer circumferential surface of the eccentric cam 450. As will be later described in detail, the first cam portion 450A forms a separating state, and the second cam portion 450B forms a contact state. In accordance with image formation information, the drive motor M1 is controlled to rotate the pair of eccentric cams 450, thereby changing the portion of the pair of eccentric cams 450 that comes in contact with the pair of rollers 406. The eccentric cams 450 have the same profile and are fixed to the shaft 33A at the same phase.

That is, as illustrated in FIG. 6, when the first cam portion 450A is separated from the roller 406, the first support assembly 40 (not shown in FIG. 6) is moved up pivotally about the rotary shaft 43 in a contact direction by the coil spring 46, causing the intermediate transfer belt 31 and the secondary transfer belt 36 to come in contact with each other. By contrast, as illustrated in FIG. 7, when the second cam portion 450B is in contact with the roller 406, the second cam portion 450B pushes the roller 406 in a separating direction, thereby pivotally moving down the first support assembly 40 (not shown in FIG. 7) about the rotary shaft 43. In this configuration, the intermediate transfer belt 31 and the secondary transfer belt 36 are separated from each other.

It is to be noted that the image formation information includes signals that are generated upon image formation when an image is transferred onto a recording medium P and upon forming a test toner pattern for an adjustment of an image density of the image to be transferred onto a recording medium P.

The image forming apparatus 500 has an image adjustment mode in which an image density is adjusted. When the image adjustment mode is set, the signals, i.e., the image formation information, are generated, and the test toner pattern for the adjustment of the image density is formed on the intermediate transfer belt 31. The test toner pattern is transferred not onto a recording medium P, but transferred onto the secondary transfer belt 36 in the secondary transfer nip N. In the image adjustment mode, the pattern detector 45 detects the density of the test toner pattern transferred onto the secondary transfer belt 36. In accordance with the image density information detected by the pattern detector 45, a controller carries out feed-back control such that the image density of the test toner pattern has a predetermined value. The condition of the image bearer detected by the pattern detector is the density of the test toner pattern.

Embodiment 1

With reference to FIGS. 3 through 8, a description is provided of installation of the pattern detector 45 according to an illustrative embodiment of the present disclosure.

Figure 8:
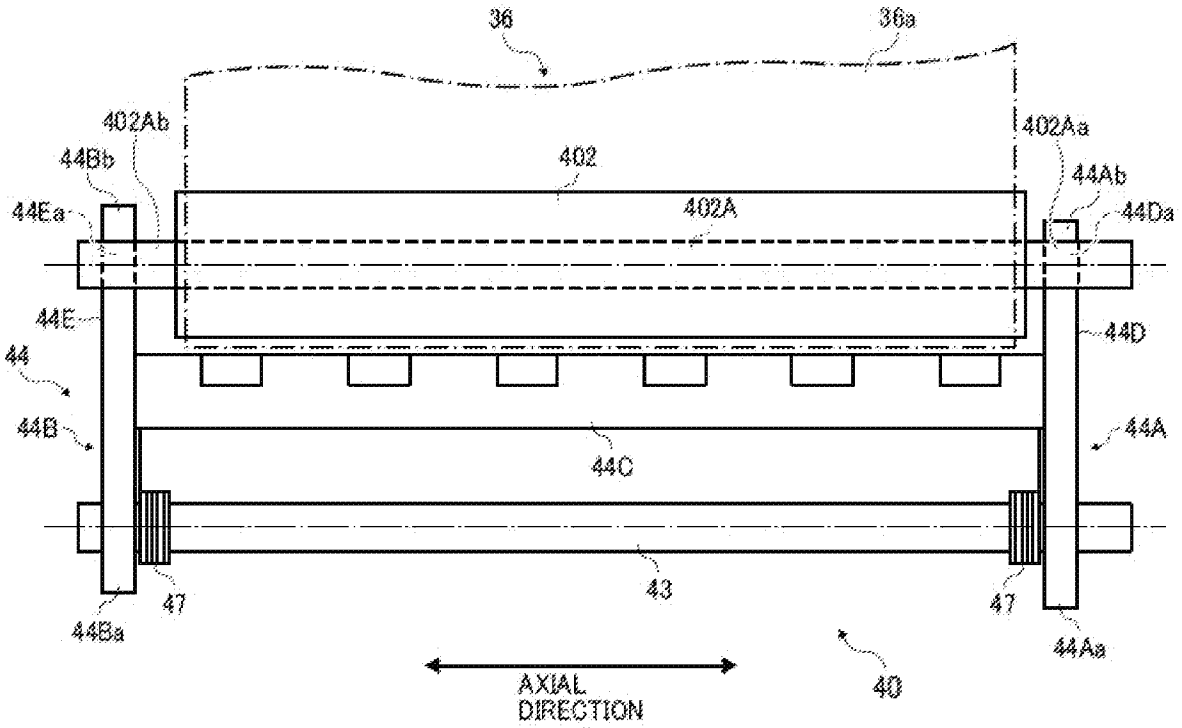
FIG. 8 is a schematic diagram illustrating the image bearer and a detector support that swingably supports the detector.

As illustrated in FIGS. 3 and 8, the pattern detector 45 detects optically the density of the test toner patterns on the secondary transfer belt 36. For example, the pattern detector 45 is a known detector that irradiates detection light against the secondary transfer belt 36 and receives reflected light from the secondary transfer belt 36.

As illustrated in FIG. 8, the detector retainer 44 that supports the pattern detector 45 includes arms 44A and 44B, a support 44C, and contact portions 44D and 44E. The arms 44A and 44B are disposed in the axial direction of the nip forming roller 400, which coincides with a width direction of the secondary transfer belt 36. The support 44C, and the contact portions 44D and 44E are disposed across the arms 44A and 44B. As illustrated in FIGS. 3 and 4, a first end 44Aa of the arm 44A and a first end 44Ba of the arm 44B are swingably supported by the rotary shaft 43. Second ends 44Ab and 44Bb, which are on the opposite ends of the first ends 44Aa and 44Ba, respectively, extend to the roller shaft 402A of the roller 402. The support 44C has a planar shape and is disposed at a place at which the secondary transfer belt 36 is looped around the roller 402 among the entire secondary transfer belt 36 in its circumference direction. A plurality of pattern detectors 45 is arranged on the support 44C in the axial direction of the nip forming roller 400. The plurality of pattern detectors 45 is disposed opposite to a surface 36*a* (illustrated in FIG. 8) of the secondary transfer belt 36 with a certain gap therebetween. More specifically, each detection surface 45*a* of the plurality of pattern detectors 45 faces a surface 36*a* (illustrated in FIG. 8) of the secondary transfer belt 36 looped around the roller 402. The plurality of pattern detectors 45 is fixed to the support 44C.

That is, the detector retainer 44 supports the pattern detectors 45 in such a manner that the pattern detectors 45 is pivotally movable about the rotary shaft 43 as a fulcrum. The rotary shaft 43 as the fulcrum serves also as a fulcrum to pivotally support the first support assembly 40 that supports or holds the secondary transfer unit 41. In this configuration, the secondary transfer unit 41 including the secondary transfer belt 36 and the pattern detectors 45 are pivotally supported by a common fulcrum, that is, the rotary shaft 43. In FIGS. 4 and 5, the detector retainer 44 moves up in a first direction indicated by arrow A1, and the detector retainer 44 moves down in a second direction indicated by arrow A2. The detector retainer 44 is pivotally supported by the rotary shaft 43 in the first direction A1 and the second direction A2.

As illustrated in FIG. 8, the contact portions 44D and 44E are formed on the second ends 44Ab and 44Bb of the arms 44A and 44B, rather than on the support 44C. When the secondary transfer unit 41 is installed in the first support assembly 40, shaft ends 402Aa and 402Ab of the roller shaft 402A come into contact with the contact portions 44D and 44E, respectively. More specifically, the place of the contact portions 44D and 44E coming in contact with the shaft ends 402Aa and 402Ab of the shaft 402A is flat. In other words, the contact portions 44D and 44E include planar positioning surfaces 44Da and 44Ea, respectively, that contact the shaft ends 402Aa and 402Ab of the shaft 402A.

Figure 9:
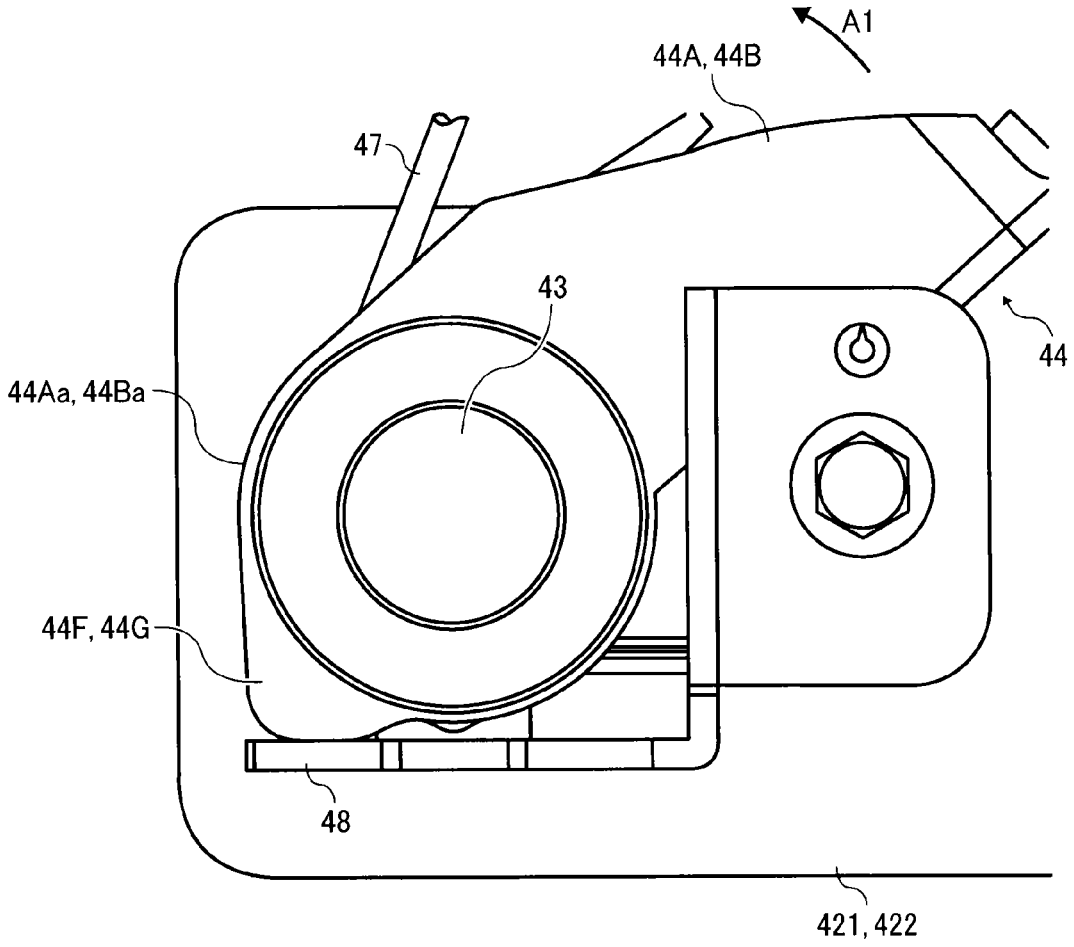
FIG. 9 is an enlarged schematic diagram illustrating the detector support at the fulcrum side.

With reference to FIGS. 4 and 5, a description is provided of the detector retainer 44 according to an illustrative embodiment of the present disclosure. As illustrated in FIGS. 4 and 5, the detector retainer 44 is biased by a helical torsion spring 47 wound around the rotary shaft 43 such that the detector retainer 44 can rotate towards the first direction A1. The first ends 44Aa and 44Ba of the arms 44A and 44B on the supporting side on which the detector retainer 44 is swingably supported include projections 44F and 44G serving as range controllers to determine a range of swingable movement of the detector retainer 44 in the first direction A1. As illustrated in FIG. 9, the projections 44F and 44G project beyond the first end 44Aa and the first end 44Ba, respectively, in a radial direction perpendicular to the axis of the rotary shaft 43. As the detector retainer 44 moves in the first direction A1, the projections 44F and 44G come in contact with walls 48 surrounding the first ends 44Aa and 44Ba of the rotary shaft 43. The walls 48 are disposed on the base plates 421 and 422.

The arms 44A and 44B, the support 44C, the contact portions 44D and 44E, and the projections 44F and 44G are obtained through monolithic molding of sheet metal as a single integrated unit. This configuration reduces assembly errors as compared with assembling individual parts into a single unit.

According to the present illustrative embodiment, when the projections 44F and 44G, and the walls 48 contact, the opening angle of the detector retainer 44 is at its maximum in the first direction A1. When the secondary transfer unit 41 is installed in the first support assembly 40, this maximum opening of the detector retainer 44 is on the first direction A1 side relative to a position pressed by the roller shaft 402A when coming in contact with the roller shaft 402A.

More specifically, among the plurality of roller shafts around which the secondary transfer belt 36 is looped, the shaft ends 402Aa and 402Ab of the roller shaft 402A of the roller 402 facing the plurality of pattern detectors 45 contact the contact portions 44D and 44E. Thus, the roller shaft 402A of the roller 402 functions as a stopper to regulate the swingable movement of the plurality of pattern detectors 45 in the first direction A1.

According to the present illustrative embodiment, the secondary transfer belt 36 and the plurality of pattern detectors 45 are pivotally supported by a common fulcrum, that is, the rotary shaft 43. Furthermore, the rotary shaft 43 regulates the swingable movement of the plurality of pattern detectors 45, that is, the swingable movement of the detector retainer 44 including the plurality of pattern detectors 45. In this configuration, when the secondary transfer unit 41 is installed in the first support assembly 40, the roller shaft 402A contacts the positioning surfaces 44Da and 44Ea of the contact portions 44D and 44E, pushing down the detector retainer 44 in the second direction A2 against a biasing force.

Accordingly, even when the secondary transfer unit 41 is detached from the first support assembly 40 to replace with a new secondary transfer unit, it is not necessary to replace or reassemble the plurality of pattern detectors 45, thereby simplifying installation operation. Furthermore, since it is not necessary to replace the pattern detectors 45, the cost can be saved and it is good for the environment.

Still further, when the pattern detectors 45 remain unchanged, the installation accuracy of the pattern detectors 45 can be maintained so that a technician who replaces the secondary transfer unit 41 is not required of a skill for attachment and detachment of the pattern detectors 45. This configuration facilitates replacement of the secondary transfer unit 41, hence increasing the operating efficiency and maintaining reliably the distance between the pattern detectors 45 and the secondary transfer belt 36.

The plurality of pattern detectors 45 is mounted on the detector retainer 44 pivotally supported by the rotary shaft 43 which also serves as a fulcrum for the secondary transfer belt 36. The plurality of pattern detectors 45 is disposed opposite to the curved surface of the surface 36*a* of the secondary transfer belt 36 wound around the roller 402. With this configuration, attachment and detachment of the secondary transfer unit 41 hardly affect the plurality of pattern detectors 45 while reducing the assembly errors. Therefore, the plurality of pattern detectors 45 and the secondary transfer belt 36 are positioned in place accurately, and the distance between the plurality of pattern detectors 45 and the secondary transfer belt 36 can be reliably maintained. Fluctuations in detection of the density of test toner patterns by the pattern detectors 45 are reduced so that the image density can be adjusted accurately, hence forming an image with good quality.

The detector retainer 44 supporting the plurality of pattern detectors 45 contacts the roller shaft 402A while the detector retainer 44 is biased by the helical torsion spring 47. With this configuration, even when the main body 501 and the secondary transfer unit 41 vibrate, the swingable movement of the detector retainer 44 absorbs the vibration. With this configuration, the roller shaft 402A and the contact portions 44D and 44E remain contacting with each other, so that fluctuations in the positional relation between the plurality of pattern detectors 45 and the secondary transfer belt 36 are insignificant. In a configuration in which the plurality of pattern detectors 45 is disposed at the main body 501 side, the detection accuracy of the plurality of pattern detectors 45 can be reliably maintained. Therefore, the distance between the plurality of pattern detectors 45 and the secondary transfer belt 36 can be reliably maintained.

The positioning surfaces 44Da and 44Ea of the contact portions 44D and 44E of the detector retainer 44 contact or pressingly contact the roller shaft 402A serving as the stopper, more specifically, the shaft ends 402Aa and 402Ab, thereby keeping reliably the positioning surfaces 44Da and 44Ea in contact with the shaft ends 402Aa and 402Ab.

Examples of the shape of the positioning surfaces 44Da and 44Ea include a curved surface and a planar surface. Considering the fact that the detector retainer 44 is swingably movable, preferably, the shape of the positioning surfaces 44Da and 44Ea is planar, thereby increasing a contact area that contacts the roller shaft 402A.

Embodiment 2

Figure 10:
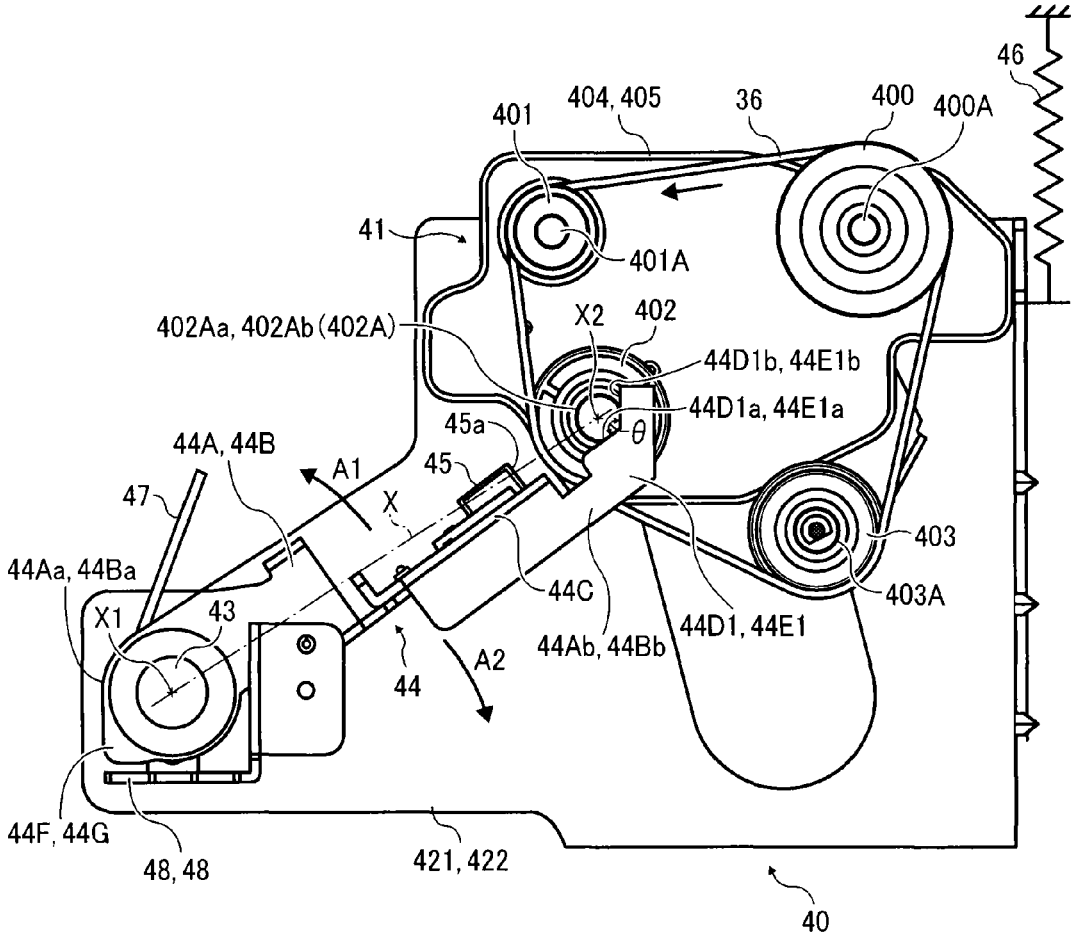
FIG. 10 is a side view schematically illustrating an image bearer support of Embodiment 2 installed on the main-body side support.

With reference to FIG. 10, a description is provided of another illustrative embodiment of the present disclosure. According to Embodiment 2, the configuration of the contact portions of the detector retainer 44 is different from that of EMBODIMENT 1. Except for the configurations described above, the configurations in the present illustrative embodiment are similar to or the same as in Embodiment 1. Thus, the description is provided mainly of the contact portions.

As illustrated in FIG. 10, the detector retainer 44 pivotally supported by the rotary shaft 43 serving as a common fulcrum for the secondary transfer unit 41 and the pattern detectors 45 includes contact portions 44D1 and 44E1 that contact the shaft ends 402Aa and 402Ab of the roller shaft 402A. The contact portions 44D1 and 44E1 are disposed opposite to the roller shaft 402A as a stopper that supports rotatably the roller 402 facing the plurality of pattern detectors 45. The contact portions 44D1 and 44E1 are formed integrally with other parts of the detector retainer 44 through plate work or the like.

According to the present illustrative embodiment, the contact portions 44D1 and 44E1 include at least two surfaces that contact the shaft ends 402Aa and 402Ab of the roller shaft 402A in different directions. More specifically, the contact portion 44D1 includes a pair of a first surface 44D1*a* and a second surface 44D1*b*, and the contact portion 44E1 includes a pair of a first surface 44E1*a* and a second surface 44E1*b*. The first surfaces 44D1*a* and 44E1*a* are planer surfaces that contact the shaft ends 402Aa and 402Ab of the roller shaft 402A in the second direction A2 when the secondary transfer unit 41 is installed in the first support assembly 40. The second surfaces 44D1*b* and 44E1*b* are disposed apart from the rotary shaft 43, more than the first surfaces 44D1*a* and 44E1*a*, and are continuous with the first surfaces 44D1*a* and 44E1*a*. The second surfaces 44D1*b* and 44E1*b* are planar surfaces that push the roller shaft 402A in the first direction A1 when the detector retainer 44 swingably moves in the first direction A1.

According to the present illustrative embodiment, each of the contact portions 44D1 and 44E1 has a V-shape with the first surface 44D1*a* and the second surface 44D1, and the first surface 44E1*a* and the second surface 44E1*b*, respectively. With this configuration, the roller shaft 402A is supported from the first direction A1 even when vibration or the like causes the detector retainer 44 to move swingably. More specifically, the first surfaces 44D1*a* and 44E1*a* are planar surfaces disposed on the second direction A2 side relative to a virtual straight line X between a center of rotation X1 of the rotary shaft 43 and a center of rotation X2 of the rotary shaft 402A. The second surfaces 44D1*b* and 44E1*b* are planar surfaces disposed on a tangent line X3 touching the roller shaft 402A on the first direction A1 side relative to the virtual straight line X. An angle θ formed between the first surface 44D1*a* and the second surface 44D1*b*, and between the first surface 44E1*a* and the second surface 44E1*b* is an obtuse angle.

According to the present illustrative embodiment, the first surfaces 44D1*a* and 44E1*a*, and the second surfaces 44D1*b* and 44E1*b* that come in contact with the roller shaft 402A (shaft end portions 402Aa and 402Ab) from different directions are formed on the respective contact portions 44D1 and 44E1. With this configuration, the roller shaft 402A and the contact portions 44D1 and 44E1 can contact more reliably. Therefore, the distance between the plurality of pattern detectors 45 and the secondary transfer belt 36 can be reliably maintained.

The illustrative embodiments of the present disclosure are employed to prevent fluctuations in the distance between the secondary transfer belt 36 serving as the image bearer and the plurality of pattern detectors 45 to detect test toner patterns transferred on the secondary transfer belt 36. The present disclosure is employed in the secondary transfer unit 41 and the first support assembly 40. The application of the present disclosure is not limited thereto.

Figure 11:
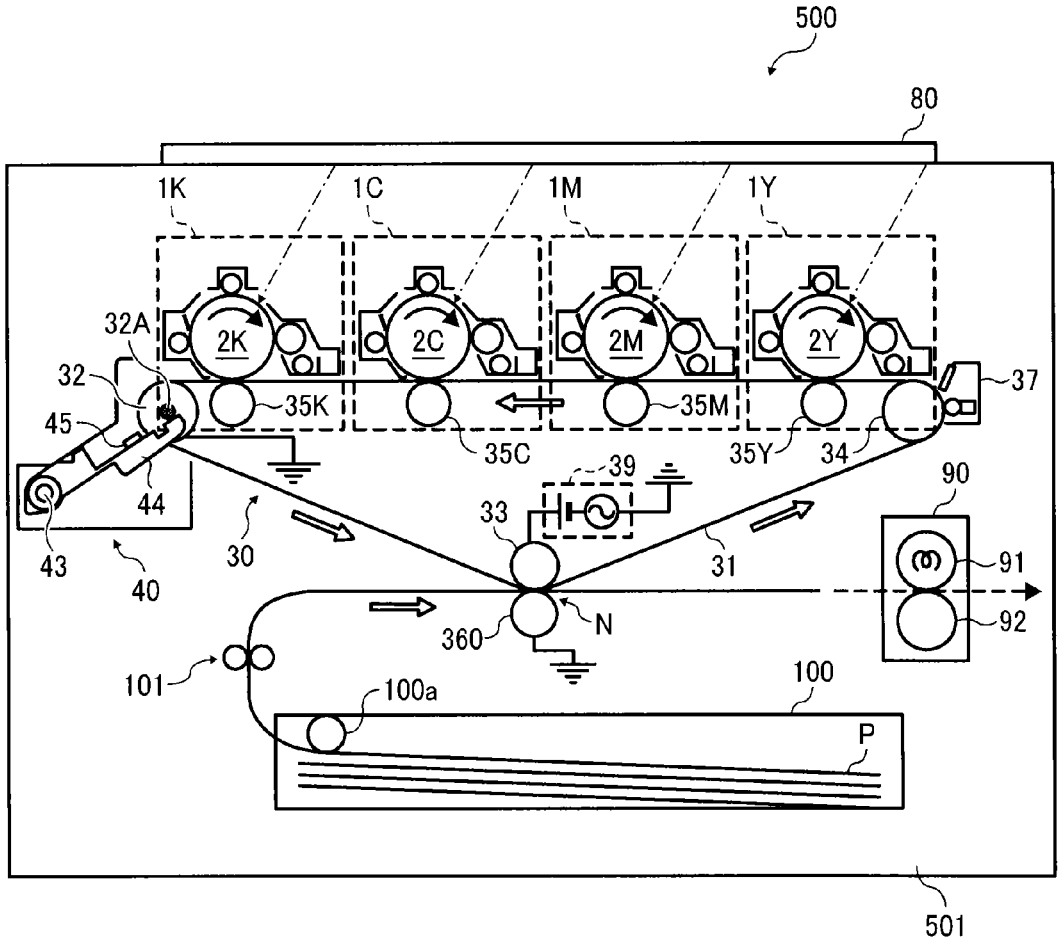
FIG. 11 is a schematic diagram illustrating another example of an image forming apparatus.

The test toner pattern used to detect the density of an image is formed on the intermediate transfer belt 31 before being transferred onto the secondary transfer belt 36. As illustrated in FIG. 11, the intermediate transfer belt 31 is considered as an image bearer, and the pattern detectors 45 are disposed opposite to the portion of the intermediate transfer belt 31 looped around the drive roller 32. In the image forming apparatus 500 of the present disclosure, in a case in which a monochrome image is formed, a movable support plate supporting the primary transfer rollers 35Y, 35M, and 35C of the transfer unit 30 is pivotally moved so as to separate the primary transfer rollers 35Y, 35M, and 35C from the photoconductors 2Y, 2M, and 2C.

For example, in the case of the transfer unit 30, the transfer unit 30 is pivotally supported such that the transfer unit 30 is swingably movable about a roller shaft 32A of the drive roller 32. The roller shaft 32A of the drive roller 32 is detachably and rotatably supported by the first support assembly 40. The plurality of pattern detectors 45 is mounted on the detector retainer 44 which is pivotally supported by the rotary shaft 43 of the first support assembly 40. In this configuration, the roller shaft 32A of the drive roller 32 serves as the stopper that regulates the movement of the detector retainer 44 in the first direction A1. Accordingly, the present disclosure can be applied to the transfer unit 30.

According to the present illustrative embodiment, the detector detects conditions of the density of the test toner pattern formed on the image bearer as the condition of the image bearer. However, the condition of the image bearer detected by the detector is not limited to the condition of the density of the test toner pattern. For example, in the image forming apparatus 500 the voltage detector 38, which is disposed spaced apart from a surface 31*a* of the intermediate transfer belt 31, detects (measures) the surface potential of the toner image (the image to be transferred onto the recording medium P) on the intermediate transfer belt 31. Fluctuations in the distance between the voltage detector 38 and the surface 31*a* of the intermediate transfer belt 31 can cause detection failure.

In view of the above, the condition of the image bearer detected by the detector includes the potential of the surface of the intermediate transfer belt 31, and the voltage detector 38 that detects the potential thereof is changed to the pattern detector 45 illustrated in FIG. 11. The pattern detector 45 is supported by the detector retainer 44. This configuration is preferable because fluctuations in the distance between the voltage detector 38 and the intermediate transfer belt 31 can be prevented.

Figure 12:
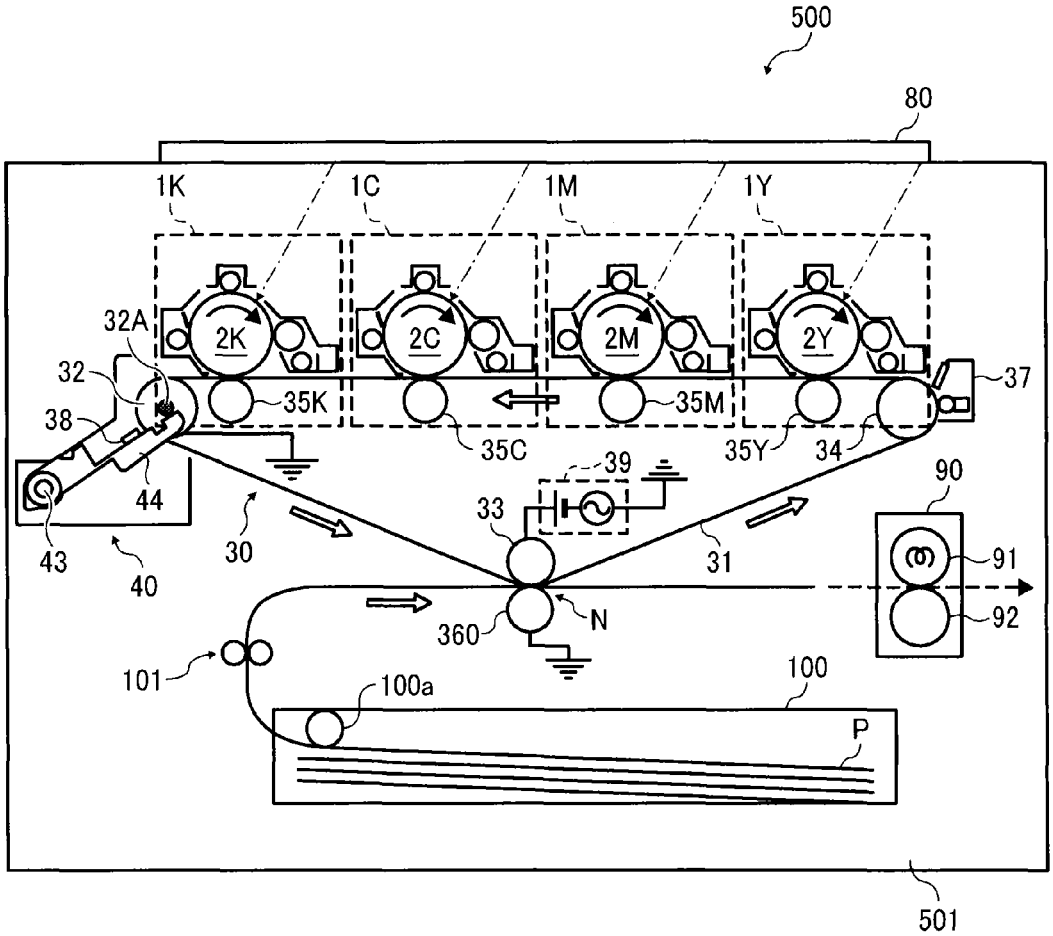
FIG. 12 is a schematic diagram illustrating another example of an image forming apparatus.

It is to be noted that in the configurations illustrated in FIGS. 11 and 12, instead of the secondary transfer unit 41, a secondary transfer roller 360 serving as a secondary transfer device is disposed opposite to the secondary-transfer back surface roller 33 via the intermediate transfer belt 31 to form the secondary transfer nip N. Alternatively, in some embodiments, the secondary transfer unit 41 may be disposed independent of the first support assembly 40.

Figure 13:
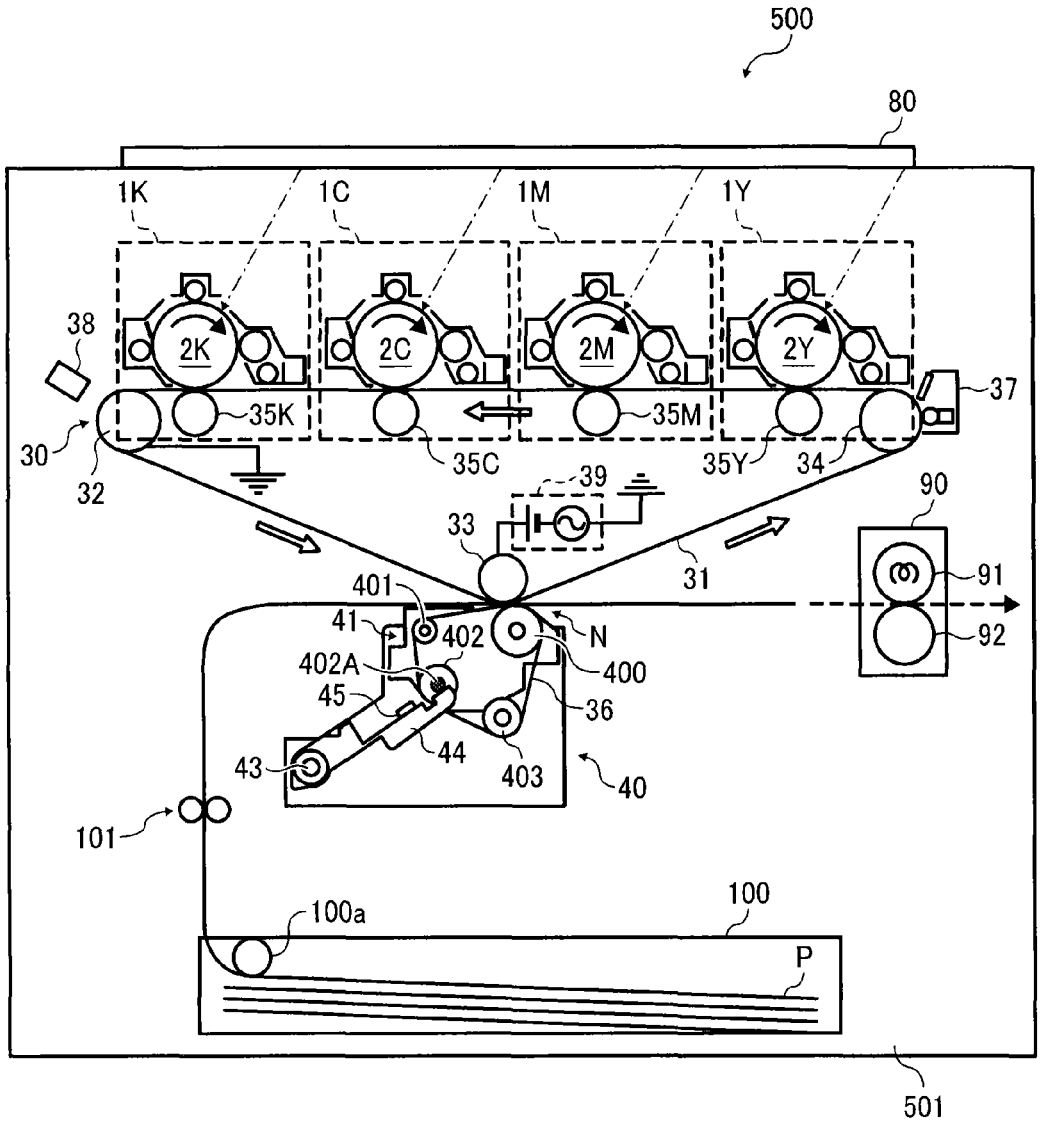
FIG. 13 is a schematic diagram illustrating another example of an image forming apparatus.

In one example of the first support assembly 40 to support the secondary transfer unit 41 equipped with the secondary transfer belt 36 such as illustrated in FIG. 1, the roller 401 is disposed downstream from the secondary transfer nip N in the direction of paper conveyance indicated by arrow. Alternatively, in some embodiments, the roller 401 may be disposed upstream from the secondary transfer nip N such as illustrated in FIG. 13.

That is, the main body 501 of the image forming apparatus 500 includes the secondary transfer unit 41 and the first support assembly 40 that supports the secondary transfer unit 41. The first support assembly 40 detachably supports the secondary transfer unit 41. The secondary transfer unit 41 is replaceable independently. FIG. 4 illustrates a state in which the secondary transfer unit 41 is installed in the first support assembly 40. FIG. 5 illustrates a state in which the secondary transfer unit 41 is detached from the first support assembly 40.

The secondary transfer unit 41 includes the secondary-transfer back surface roller 33, the nip forming roller 400 disposed opposite to the secondary-transfer back surface roller 33 via the intermediate transfer belt 31, three rollers 401, 402, and 403, and the secondary transfer belt 36 serving as an image bearer looped around the nip forming roller 400 and three rollers 401, 402, and 403. The roller 401 illustrated in FIG. 13 serves as a belt pulley around which the secondary transfer belt 36 is simply looped, and does not function as a separation roller as compared with the roller 401 of FIG. 1 which functions as a separation roller.

The secondary transfer unit 41 is a belt conveyor unit in which the secondary transfer belt 36 is an endless looped belt serving as an image bearer, and is looped around the plurality of rollers, i.e., the nip forming roller 400, and the rollers 401, 402, and 403.

Although the embodiments of the present disclosure have been described above, the present disclosure is not limited to the embodiments described above, but a variety of modifications can naturally be made within the scope of the present disclosure.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearer to bear an image on a surface thereof:

a detector to detect a condition of the image on the image bearer, an image bearer support to support the image bearer, the image bearer support including a stopper to regulate movement of the detector, and a fulcrum to pivotally support the image bearer and the detector, wherein the image bearer has a belt shape, wherein the image bearer support includes a plurality of rollers to support the image bearer, and wherein the fulcrum is disposed outside an area enclosed by the image bearer, the area is defined by a cross-sectional view in a thickness direction of the image bearer.

2. The image forming apparatus according to claim 1, wherein the image bearer is formed into an endless loop, and wherein the image bearer support is a belt conveyor including the plurality of rollers.

3. The image forming apparatus according to claim 1, wherein the condition includes an electrical potential of the image on the image bearer, and the detector detects the electrical potential of the image.

4. The image forming apparatus according to claim 1, wherein the image bearer onto which the image is transferred is formed into an endless loop, and the image bearer support is a belt conveyor including a plurality of rollers to transport the image on the image bearer to a transfer portion at which the image is transferred onto a recording medium.

5. The image forming apparatus according to claim 4, wherein the condition includes a density of the image transferred onto the image bearer, and the detector detects the density of the image on the image bearer.

6. The image forming apparatus according to claim 1, wherein the stopper is a roller shaft of one of the plurality of rollers.

7. An image forming apparatus, comprising:

an image bearer to bear an image on a surface thereof;

a detector to detect a condition of the image on the image bearer; and a support to pivotally support the image bearer about a fulcrum; and a detector retainer to pivotally support the detector about the fulcrum, wherein the support including a stopper to regulate movement of the detector retainer, wherein the image bearer has a belt shape, wherein the support includes a plurality of rollers to support the imager bearer, and wherein the fulcrum is disposed outside an area enclosed by the image bearer, the area is defined by a cross-sectional view in a thickness direction of the image bearer.

8. The image forming apparatus according to claim 7, wherein the support includes a first support to support the image bearer and a second support to support the first support, wherein the first support is detachably attachable relative to the second support, and wherein the detector retainer includes a contact surface to contact the stopper as the first support is installed in the second support.

9. The image forming apparatus according to claim 7, wherein the detector retainer includes at least two planar positioning surfaces that contact the stopper from different directions.

10. The image forming apparatus according to claim 7, wherein the stopper is a roller shaft of one of the plurality of rollers.

11. The image forming apparatus according to claim 1, wherein the stopper regulates rotational movement of a detector retainer around the fulcrum.

12. The image forming apparatus according to claim 7, wherein the stopper regulates the rotational movement of the detector retainer around the fulcrum.

13. The image forming apparatus according to claim 1, further comprising a detector retainer that includes a support that extends along an axis of the fulcrum and supports the detector, wherein the detector retainer further includes at least two arms that attach to the fulcrum and extend in a radial direction, and wherein the detector retainer pivotally supports the detector.

14. The image forming apparatus according to claim 13, wherein the at least two arms each include a planar positioning surface positioned at a first end of the arm opposite the fulcrum, and wherein the planar positioning surfaces contacts the stopper, the stopper being a roller shaft which is one of the plurality of rollers.

15. The image forming apparatus according to claim 14, further comprising at least one coil spring wound around the fulcrum, wherein the at least one coil spring is configured to bias the planar positioning surfaces toward the roller shaft.

16. The image forming apparatus according to claim 14, wherein the image bearer support is detachably attachable to a main body of the image forming apparatus, wherein the detector retainer includes at least one projection that extends from a second end of the arm near the fulcrum and is disposed away from a wall of the main body, and wherein the at least one projection is configured to contact the wall of the main body when the image bearer support is detached from the main body.

17. The image forming apparatus according to claim 14, wherein a distance from the each of the planar positioning surfaces to the fulcrum is longer than a distance from the detector to the fulcrum.

* * * * *